US008328665B2

(12) United States Patent
Meltzer et al.

(10) Patent No.: US 8,328,665 B2
(45) Date of Patent: Dec. 11, 2012

(54) COMBINATION PITCHING AID AND BATTING TEE

(75) Inventors: Duane Meltzer, Encino, CA (US); William Tan, Los Angeles, CA (US)

(73) Assignee: Meltzer Investment Company, LLC, North Hollywood, CA (US)

( * ) Notice: Subject to any disclaimer, the term of this patent is extended or adjusted under 35 U.S.C. 154(b) by 0 days.

(21) Appl. No.: 13/151,382

(22) Filed: Jun. 2, 2011

(65) Prior Publication Data

US 2011/0230282 A1 Sep. 22, 2011

Related U.S. Application Data

(63) Continuation of application No. 12/245,690, filed on Oct. 3, 2008, now Pat. No. 7,976,413.

(60) Provisional application No. 60/997,792, filed on Oct. 6, 2007.

(51) Int. Cl.
*A63B 69/00* (2006.01)

(52) U.S. Cl. ..... 473/454; 473/422; 473/417

(58) Field of Classification Search ..... 473/417, 473/422, 423, 429, 453, 454, 439; 273/348; 248/165

See application file for complete search history.

(56) References Cited

U.S. PATENT DOCUMENTS 1,477,233 A 12/1923 Alexander
1,620,742 A 3/1927 Spafford
2,534,132 A 12/1950 Keefe
2,710,733 A 6/1955 Phillips
2,749,147 A 6/1956 Herrschaft
2,845,317 A 7/1958 Orman
2,957,736 A 10/1960 Olander et al.
3,006,647 A 10/1961 Haskett
3,039,770 A 6/1962 Ferretti
3,790,171 A 2/1974 Anderson
4,017,152 A 4/1977 Allen
4,073,484 A 2/1978 Beekenkamp
4,160,549 A 7/1979 Simpson
4,227,691 A * 10/1980 Lefebvre et al. ..... 473/417
4,629,188 A 12/1986 Mahieu
4,692,050 A 9/1987 Kaufman
4,700,498 A 10/1987 Perutz et al.
4,819,937 A 4/1989 Gordon
4,886,267 A 12/1989 Licciardi et al.
5,002,274 A 3/1991 Bidema
5,320,343 A 6/1994 McKinney
(Continued)

OTHER PUBLICATIONS

International Search Report issued on Dec. 5, 2008 in PCT/US2008/078981.

*Primary Examiner* — Mitra Aryanpour
(74) *Attorney, Agent, or Firm* — Abel Law Group, LLP

(57) ABSTRACT

Described herein is a combination pitching aid and batting tee apparatus. The apparatus includes a base having a front and a rear, a stand extending upwardly from the base, a support rod extending upwardly from the stand, and an arm extending outwardly from the support rod. The arm includes a target associated therewith that can be adjusted vertically and horizontally. The apparatus includes a screen having a top end and a bottom end and a support assembly having a top end and a bottom end that extends upwardly from the base. The bottom end of the screen is attached near the front of the base and the top end of the screen is attached to the support assembly. The support rod can be replaced with a batting tee.

14 Claims, 11 Drawing Sheets

U.S. PATENT DOCUMENTS

| | | | | |
|---|---|---|---|---|
| 5,351,948 | A | | 10/1994 | Thomas |
| 5,505,443 | A | | 4/1996 | Padilla |
| 5,540,430 | A | | 7/1996 | Nichols |
| 5,560,502 | A | | 10/1996 | Hsiung |
| 5,562,288 | A | | 10/1996 | Erkebaev |
| 5,639,243 | A | * | 6/1997 | Ryan et al. ..... 473/451 |
| 5,810,363 | A | | 9/1998 | Saunders et al. |
| 5,957,790 | A | | 9/1999 | Carfo |
| 6,086,488 | A | | 7/2000 | Sanders |
| 6,322,461 | B1 | | 11/2001 | Walsh |
| 6,620,065 | B2 | | 9/2003 | Clabough |
| 6,666,781 | B1 | | 12/2003 | Illis |
| 6,857,607 | B1 | | 2/2005 | Burris |
| 6,938,863 | B2 | | 9/2005 | LaMotte |
| 7,011,310 | B2 | | 3/2006 | Rowan |
| 7,185,861 | B2 | | 3/2007 | LaMotte |
| 7,220,194 | B1 | | 5/2007 | Laiacona, Jr. |
| 7,255,658 | B1 | | 8/2007 | VanKuiken et al. |
| 2005/0255945 | A1 | | 11/2005 | Green |
| 2006/0019775 | A1 | | 1/2006 | Nurthen |
| 2007/0207881 | A1 | | 9/2007 | Ross |

* cited by examiner

COMBINATION PITCHING AID AND BATTING TEE

CROSS-REFERENCE TO RELATED APPLICATION(S)

The present application is a continuation of U.S. patent application Ser. No. 12/245,690, filed Oct. 3, 2008, now U.S. Pat. No. 7,976,413, entitled "PORTABLE APPARATUS FOR PRACTICING AND IMPROVING PITCHING IN BASEBALL AND BATTING TEE," naming inventors Duane Meltzer and William Tan, which claims priority from U.S. Provisional Patent Application No. 60/997,792, filed Oct. 6, 2007, entitled "PORTABLE APPARATUS FOR PRACTICING AND IMPROVING PITCHING IN BASEBALL AND BATTING TEE," naming inventors Duane Meltzer, David Goetz and William Tan, which application is incorporated by reference herein in its entirety.

FIELD OF THE INVENTION

The present invention relates to sporting goods and a portable teaching and practicing apparatus for pitching, softball, cricket, football and other throwing ball sports.

BACKGROUND OF THE INVENTION

To become good at any sport requires a lot of practice, but having other players or a coach during that practice is not always available for all athletes, especially for baseball pitching. For pitching, there would need to be a pitcher, a catcher, and preferably a batter and a coach.

Baseball pitching is not an easy skill to master and requires both the combination of the physical and visual accuracy of placing a ball within a certain area called the strike zone. In baseball, the strike zone is defined as the area (as between the shoulders and knees of a batter in his natural stance) over home plate through which a pitched baseball must pass to be called a strike. See Webster's Seventh New Collegiate Dictionary.

The visual component of baseball is even greater because the pitcher is not just throwing a ball at his teammate and catcher, but the pitcher is trying to get a batter or batsman out on any combination of three strikes or three swings. In particular, with the younger athletes, there always is the inherent fear of hitting the batter. Instead of concentrating on the physical mechanics and also the placement of the pitch within the strike zone, younger athletes can become fearful, apprehensive or distracted with hitting the batter.

Many coaches in Little League and other youth baseball leagues have employed use of a bat standing on one end or a tee-ball stand to simulate a batter in the batting box. However, a bat or a tee ball stand is not going to replace a real person or a batter. Other devices in the prior art have been inflatable figures or dolls, but these devices to not provide a proper target for the pitcher to visualize the strike zone.

Another problem with current devices is their large size (gigantic in some cases) and bulk and weight. These size problems make it very difficult to assemble and disassemble on the playing field and for transportation. For example, inflatable targets or simulated batters are just cumbersome to set up and to operate on the playing field. These current devices to not disassemble or break down easily and make it difficult for younger athletes, such as an eight year old Little League player to use and to use consistently. From the preceding descriptions, it is apparent that the devices currently being used have significant disadvantages. Thus, important aspects of the technology used in the field of invention remain amenable to useful refinement.

SUMMARY OF THE PREFERRED EMBODIMENTS

The purpose of the present invention is to provide a visual aid to train athletes, in particular younger athletes (e.g., 8-12 year olds) in accurately throwing a ball, softball, cricket ball or other sporting ball toward a target area, such as a strike zone in a batter's box in baseball.

Another purpose is to provide a visual aid of a simulated strike zone or target for throwing a ball. Another purpose is to combine the target for throwing a ball with a simulated batter; another purpose is to provide an easily portable throwing target that can be adjusted along both the x-axis (horizontal) and y-axis (vertical) to allow maximum flexibility in training situations. Another purpose allows the target to simulate throwing to both right handed and left handed batters.

Another purpose is to provide an apparatus that has enough give or resilience that the apparatus can effectively remain upright after being hit by a ball or a pitch.

Another purpose of the present invention is to provide a lightweight, effective, and durable pitching training apparatus that can be easily assembled and disassembled by the user for easy transport to and from the playing field, backyard or gym.

Another purpose to allow the apparatus to be modified to accept a "tee ball" insert for batting practice for baseball, softball or wiffleball players.

The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the appended drawings.

In accordance with a first aspect of the present invention there is provided an apparatus for practicing sports. The apparatus includes a base having a front and a rear, a stand extending upwardly from the base, a support rod extending upwardly from the stand, and an arm extending outwardly from the support rod. The arm includes a target associated therewith that can be adjusted vertically and horizontally. In a preferred embodiment, the apparatus includes a screen having a top end and a bottom end and a support assembly having a top end and a bottom end that extends upwardly from the base. The bottom end of the screen is attached near the front of the base and the top end of the screen is attached to the support assembly.

In accordance with yet another aspect of the present invention there is provided a method that includes the steps of providing an apparatus for practicing sports that includes a base having a front and a rear, a stand extending upwardly from the base, a support rod extending upwardly from the stand, and an arm extending outwardly from the support rod. The arm includes a target associated therewith. The method also includes removing the support rod from the stand, and inserting a tee ball insert into an opening in the top of the stand. In a preferred embodiment, the support assembly comprises a plurality of poles and pole connectors that cooperate to form an X shape.

In accordance with yet another aspect of the present invention there is provided an apparatus for practicing sports that includes a base having a front and a rear, a stand extending upwardly from the base, a support rod received in a friction fit arrangement in an opening in the top of the stand, a horizontally oriented arm extending outwardly from the support rod that includes a target associated therewith that can be adjusted vertically and horizontally, a screen having a top end and a bottom end, and a support assembly having a top end and a bottom end and extending upwardly from the base. The bottom end of the screen is secured to the front of the base and the bottom end of the support assembly is secured to the rear of the base. The top end of the support assembly is secured to the top end of the screen.

BRIEF DESCRIPTION OF THE DRAWINGS

Like numerals refer to like parts throughout the several views of the drawings.

DESCRIPTION OF THE PREFERRED EMBODIMENTS

Figure 1:
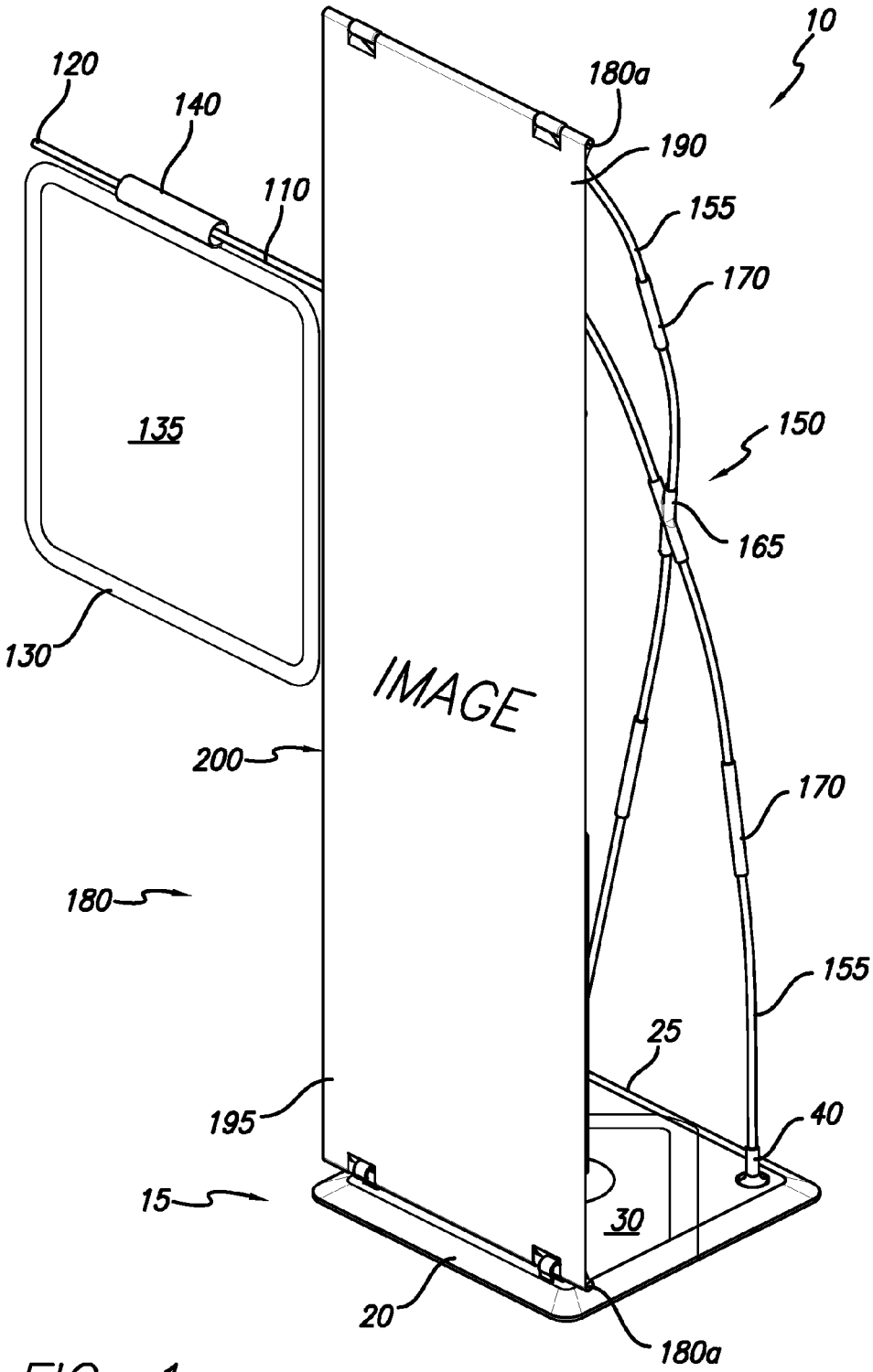
FIG. 1 is a front perspective view of a combination pitching aid and batting tee apparatus in accordance with a preferred embodiment of the present invention.
Figure 2:
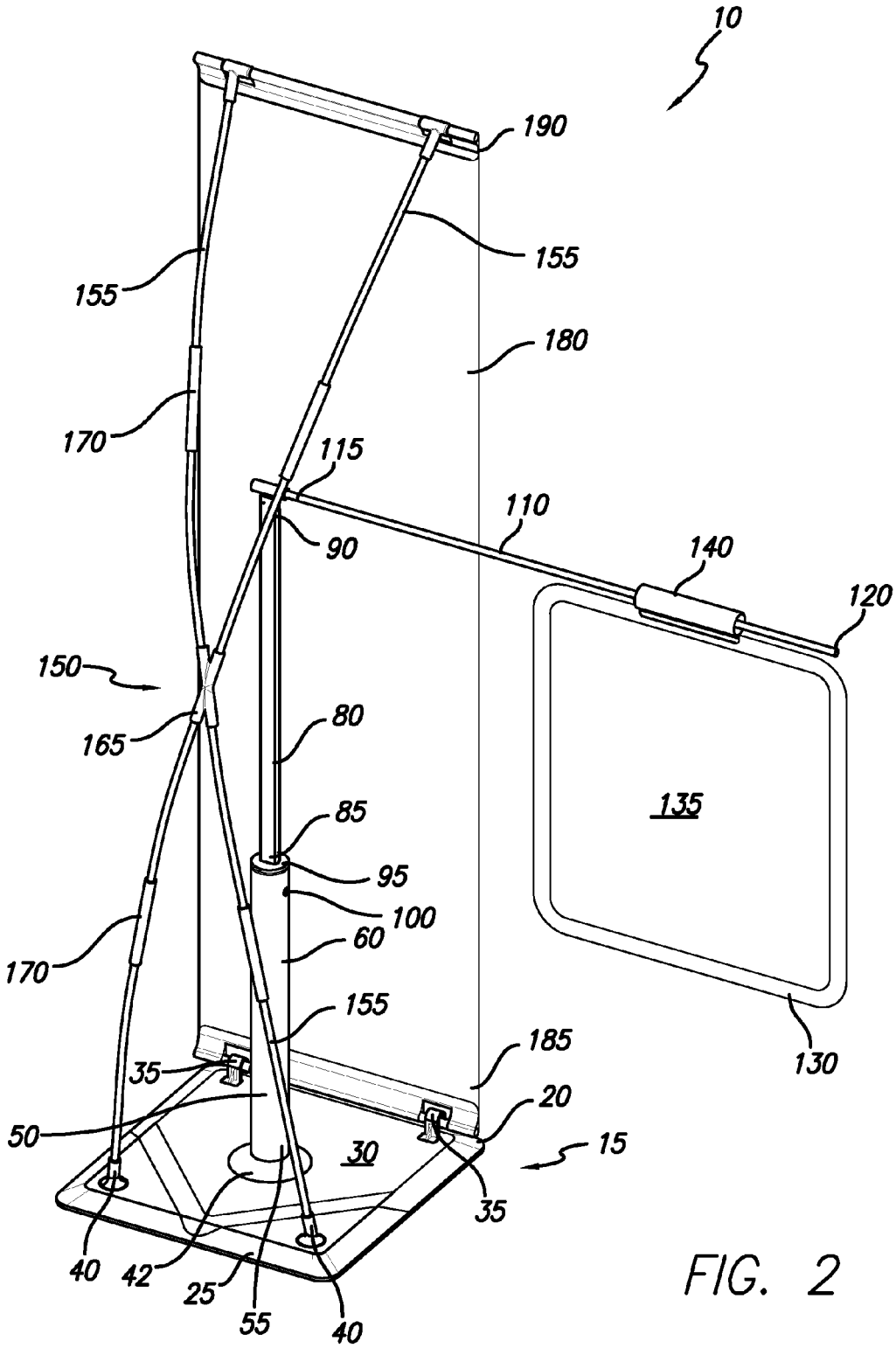
FIG. 2 is a rear perspective view of the apparatus of FIG. 1.

As shown in the drawings, for purposes of illustration, a preferred embodiment of a combination pitching aid and batting tee apparatus 10 is shown and described.

It will be appreciated that terms such as "front," "back," "top," "bottom," "side," "short," "long," "up," "down," and "below" used herein are merely for ease of description and refer to the orientation of the components as shown in the figures. It should be understood that any orientation of the combination pitching aid and batting tee apparatus 10, and the components thereof described herein is within the scope of the present invention.

FIG. 1 shows the apparatus 10 in pitching mode. Referring to FIGS. 1-11, the apparatus 10 is comprised of a base 15 with a stand 50. The stand 50 can hold an adjustable height rod 80, which supports an arm 110 and a target 130. The target 130 hangs from the arm 110 and preferably has variable dimensions similar to a strike zone. In a preferred embodiment, there is screen or panel 180, which can have the picture or image of a batter or another player thereon. The screen or panel 180 is attached to the base 15 and also to a strut or support assembly that holds the panel 180 upright, but also allows enough elastic give and/or resilience to help keep the panel 180 (and the apparatus 10) upright after a ball or an object hits the panel 180 or the apparatus 10. Preferably, the materials from which the apparatus 10 is made are relatively strong yet lightweight, such as flexible plastics (e.g., HDPE), rubber or composite materials. However, those skilled in the art will be able to choose the types of materials from which the apparatus 10 can be made.

Figure 3:
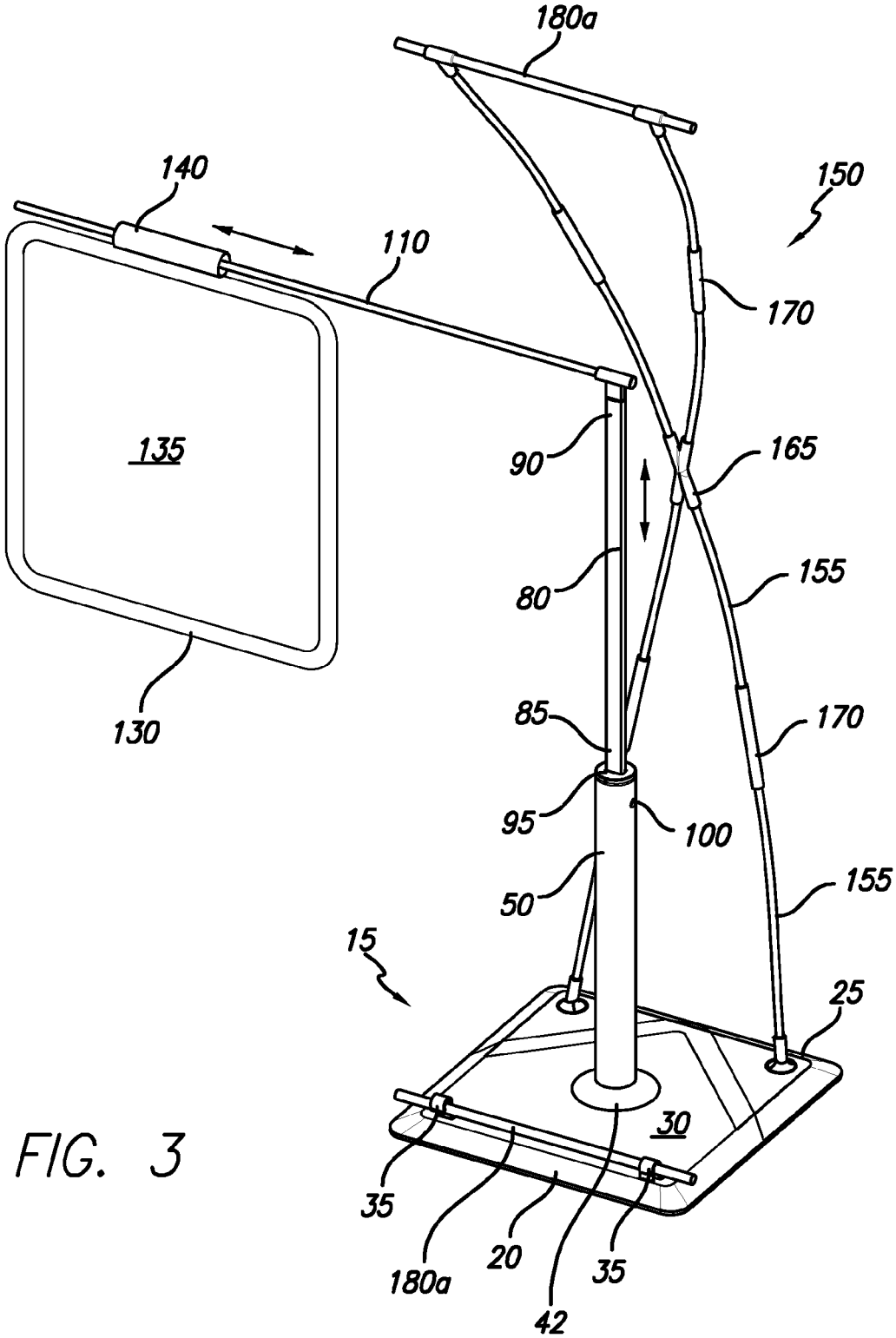
FIG. 3 is a perspective view of the apparatus of FIG. 1 with the screen removed.
Figure 4:
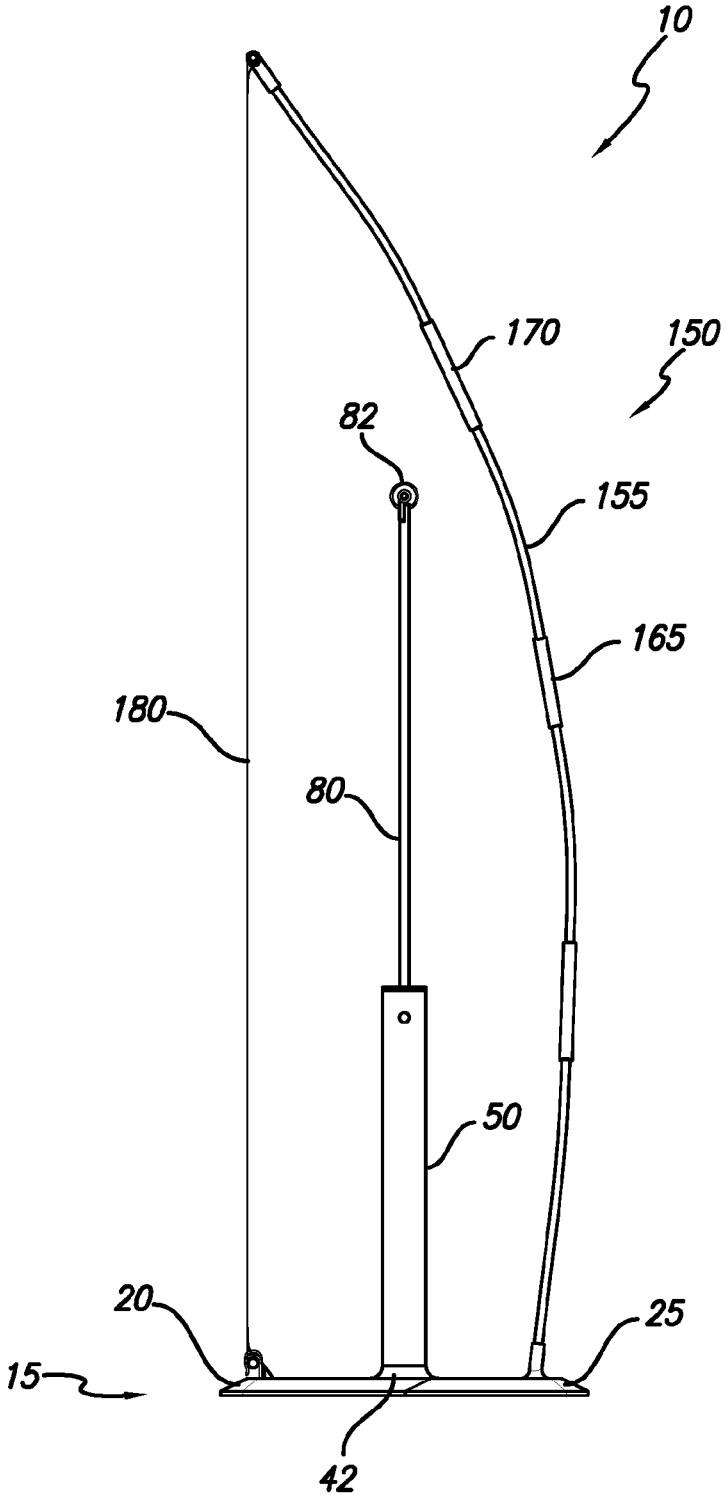
FIG. 4 is a right side elevational view of the apparatus of FIG. 1.
Figure 5:
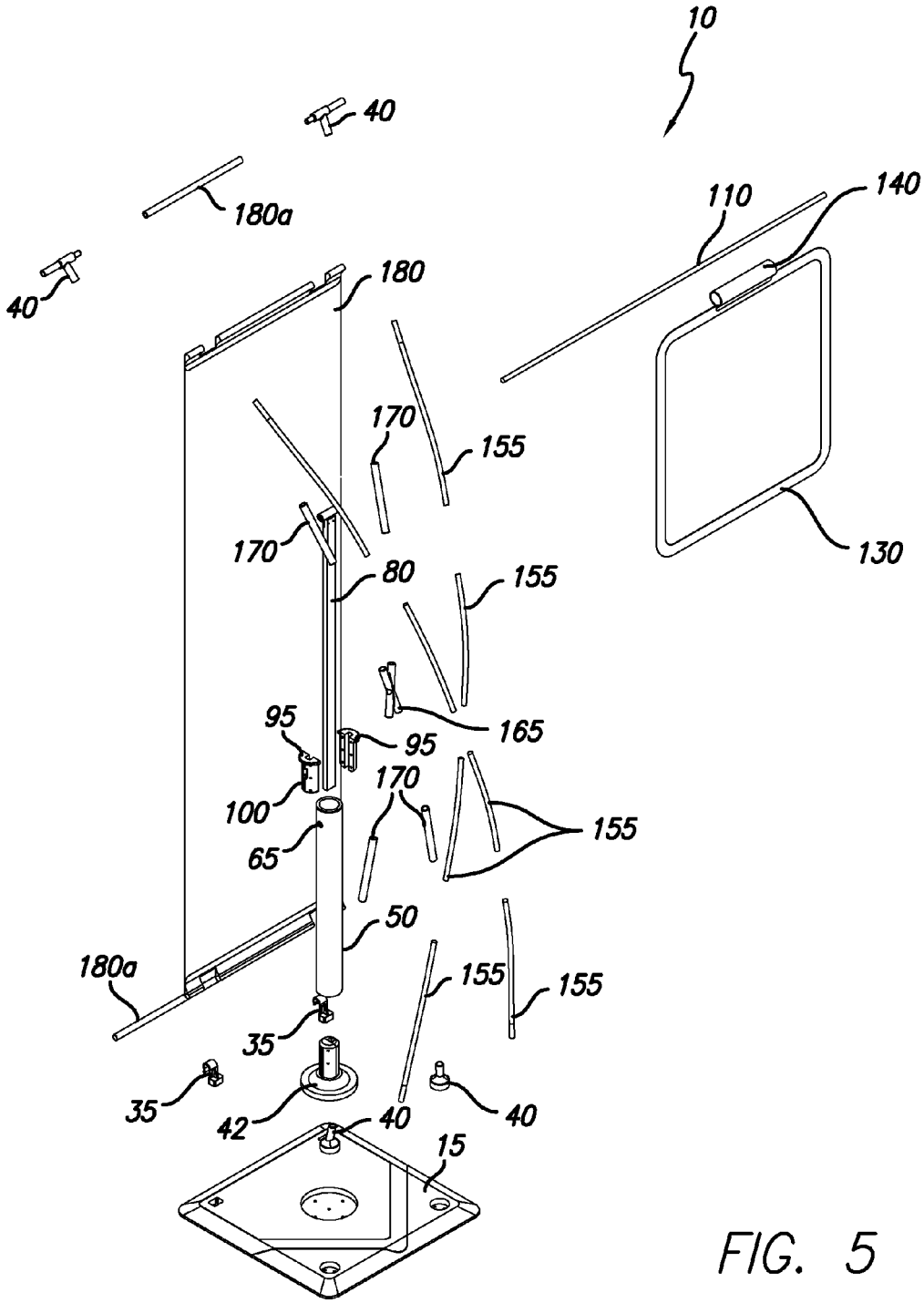
FIG. 5 is an exploded perspective view of the apparatus of FIG. 1.

FIG. 3, is a perspective view of the apparatus 10 with the panel or screen 180 removed for clarity. The base 15 includes a first or front side 20, a second or rear side 25 and a top or mounting surface 30. On or near the first or front side of the base 20, there is at least one clip or hook 35 for connecting the base 15 to the screen or panel 180. As is shown in FIG. 1, the panel 180 includes a rod **180*a* that connects the panel 180 to the clips 35. Please note that other attachment or connection devices can be used, including but not limited to clips, clasps, hook/loop connectors, buttons, and male/female connections, to connect the base to the first or bottom end 185 of the screen or panel 180**.

On or near the second or rear side 25 of the base, there is at least one female connection part, 40 to receive at least one portion of the strut or suspension assembly 150. Please note that other attachment or connection devices can be used to connect the strut or suspension assembly 150, including but not limited to clips, clasps, hook/loop connectors, buttons, and male/female connections. The base 15 can be any particular shape or size. As shown in the figures, the base 15 can be square, but can include the shape of a typical home plate thereon.

The top or mounting surface 30 of the base preferably includes a threaded connection point or male piece 42 for attaching the stand piece 50. In a preferred embodiment, the male piece is threadedly connected to the base 15 by threaded fasteners or the like. In another embodiment, the male piece can be unitary with the base 15. In yet another embodiment, the stand 50 and the base can be a unitary piece. It will be appreciated by those skilled in the art that other attachment or connection devices, including but not limited to male/female connections, can be used to connect the stand piece 50 to the base 15. As shown in the figures, the stand 50 is normally mounted in the relatively central portion of the base 15.

The stand 50 has a first or bottom end 55 and a second or top end 60. The stand 50 can be round, oval, square or other arbitrary shape. The stand 50 can be solid, hollow or semi-hollow. In one preferred embodiment, there is a key hole 65 on the side wall or near the second or top end 60 of the stand 50. This key hole 65 allows for interaction with the arm support rod's platform piece 95, as described below.

Figure 6:
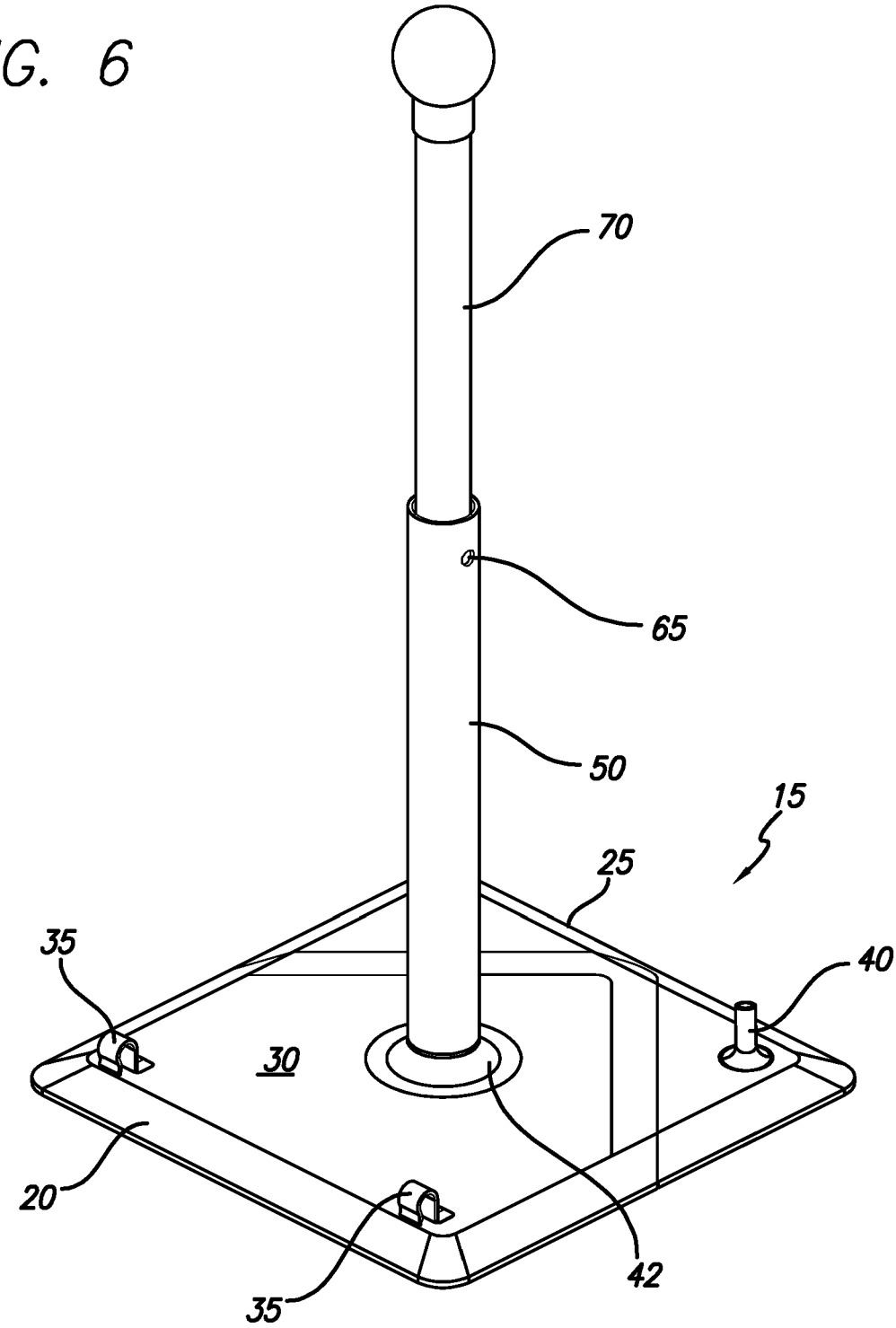
FIG. 6 is a perspective view of the apparatus of FIG. 1 in batting tee mode.
Figure 7:
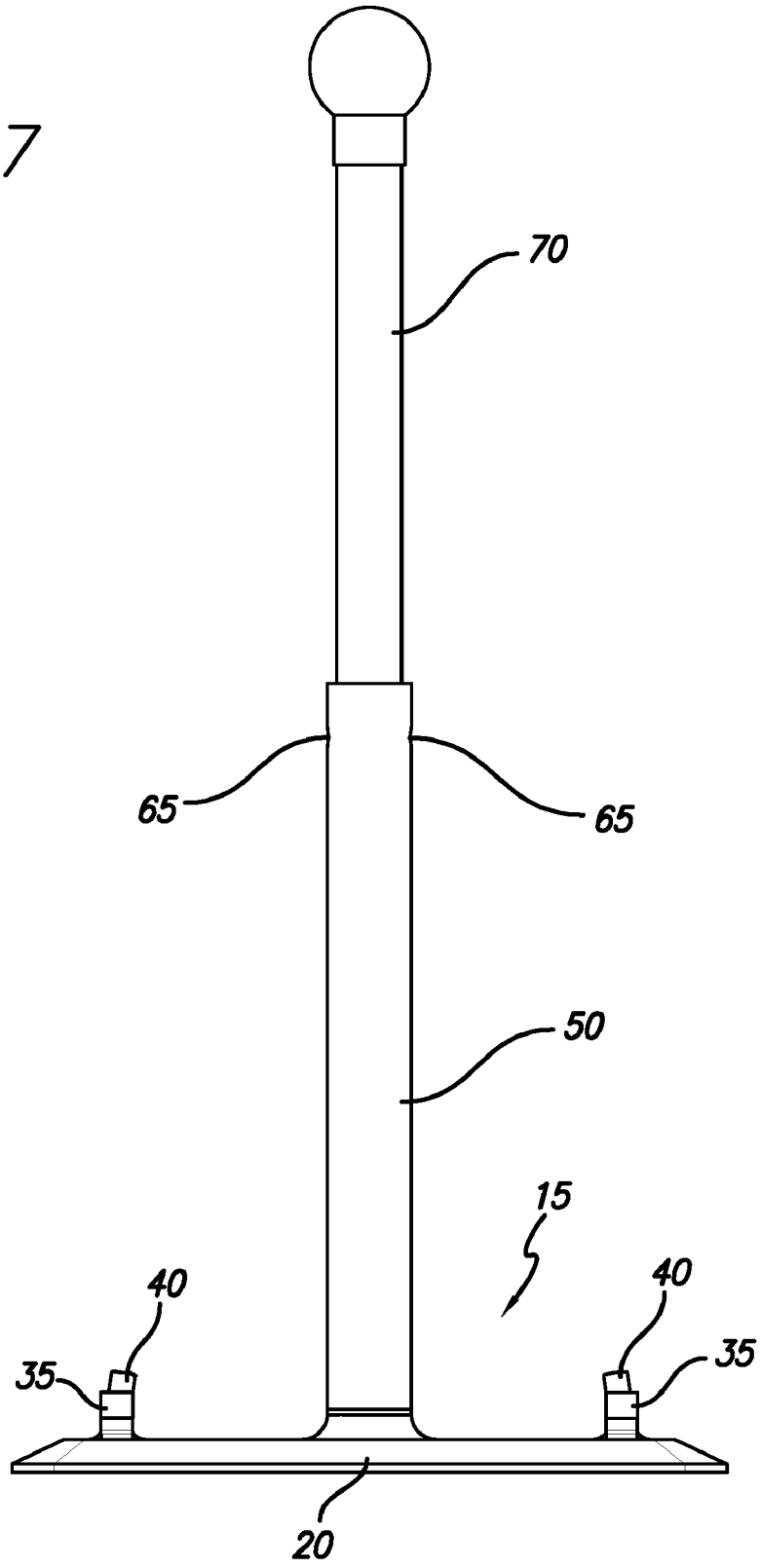
FIG. 7 is a front elevational view of the apparatus of FIG. 1 in batting tee mode.

FIGS. 6 and 7 show the apparatus 10 in batting tee mode. As shown in FIGS. 6 and 7, in a preferred embodiment, the second or top end 60 of the stand 50 can engage or receive a "tee ball" insert 70 to hold a ball for a user's batting practice. The tee ball insert 70 can be placed at a fixed height or can be adjusted to different heights using a friction fit or a key hole and spring biased button arrangement or the like.

With reference once again to FIGS. 1-5, in a preferred embodiment, the second or top end 60 of the stand 50 can also engage a telescoping or adjustable height and removable arm support rod 80. This arm support rod or piece or tube 80 has a first or bottom end 85 and a second or top end 90. In a preferred embodiment, the support rod 80 is in a telescoping arrangement with the stand 50 and can be adjusted to different heights along the axis of the stand 50. In one preferred embodiment, to provide this telescoping arrangement, an engagement piece 95 can be used. The support rod 80 fits within and slides within the engagement piece 95.

Figure 11:
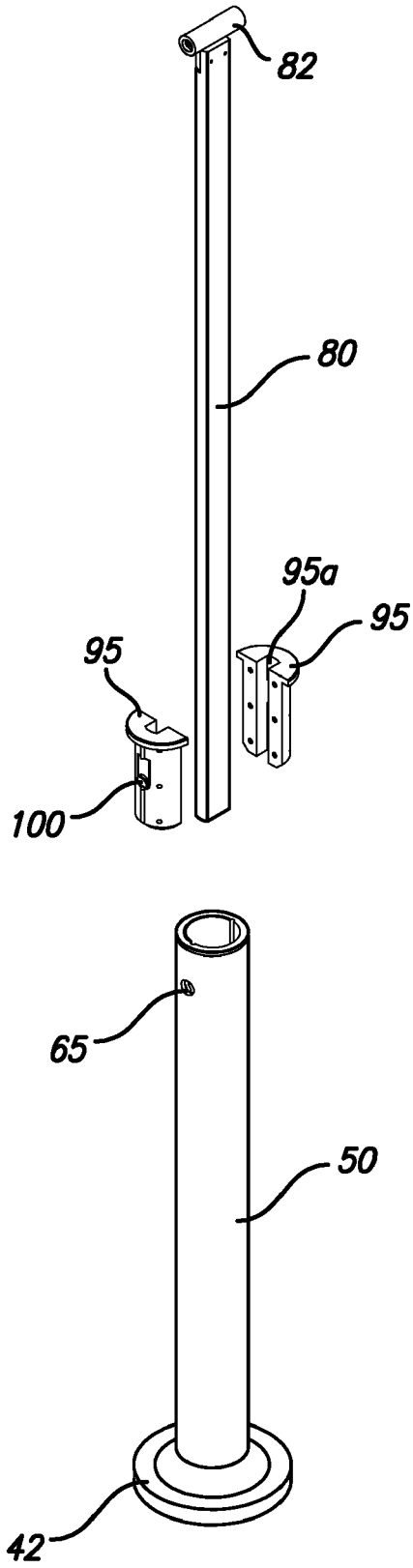
FIG. 11 is an exploded perspective view of the stand, engagement piece and support rod of the apparatus of FIG. 1.

As shown in FIG. 11, in a preferred embodiment, the engagement piece 95 can be comprised of two halves that together form an upper piece that has a larger diameter than the opening in the top of the stand 50 and that cooperate to define the slot 95*a* that receives the rod 80. In another embodiment, the engagement piece can be a unitary piece. The engagement piece 95 can also be fitted with a biased button 100 or two that extend outside the perimeter of the engagement piece housing so that the button 100 fits within the key hole 65 on the second end 60 of the stand piece 50.

In a preferred embodiment, the engagement piece 95 is secured in the stand 50 by a friction fit and the key hole 65/button 100 arrangement. The engagement piece 95 has a slot 95*a* in its top that receives the support rod 80 in a friction fit arrangement. This allows the support rod 80 to be moved up or down as desired. And, due to the friction fit with the slot of the engagement piece, the support rod 80 will be held at the desired height. Those skilled in the art will understand the proper materials and fit that will allow this type of arrangement.

To remove the support rod 80, a user can push the release button 100 on the engagement piece 95 and pull the support arm 80 and engagement piece 95 out of the stand 50 as a unit. Or, a user can simply pull the support rod 80 out of the slot in the engagement piece 95. This is one preferred embodiment of the invention, but other configurations for removable attachment can be used for the removable integration of the rod 80 to the stand 50. For example, the support rod 80 can be round and fit into the opening in the top of the stand 50 without the need for the engagement piece. In this embodiment, the rod 80 can be removed and then the tee 70 inserted when switching from pitching aid to batting tee.

Figure 9:
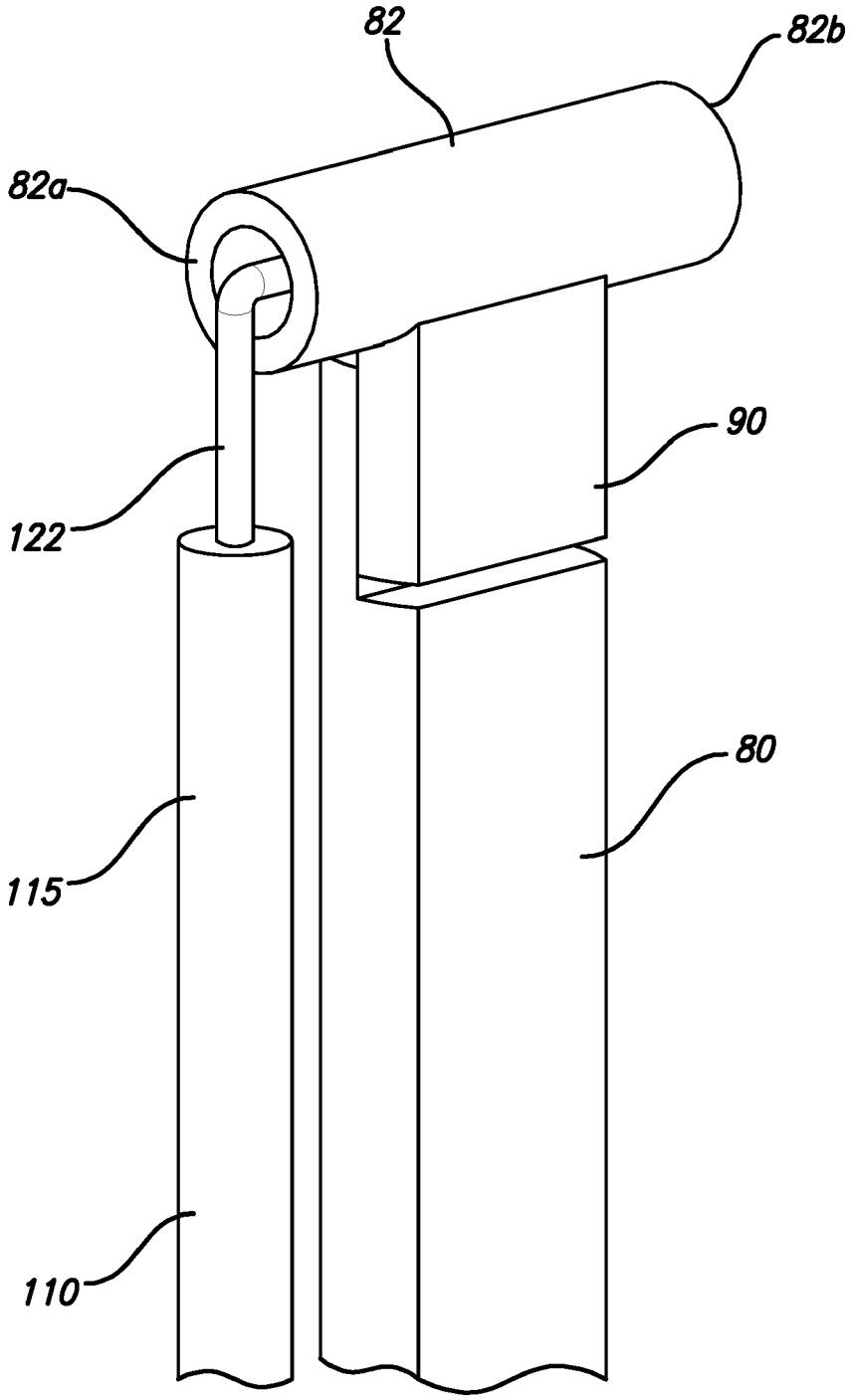
FIG. 9 is a perspective view of the support rod and target arm disconnected with the elastic cord holding them together.
Figure 10:
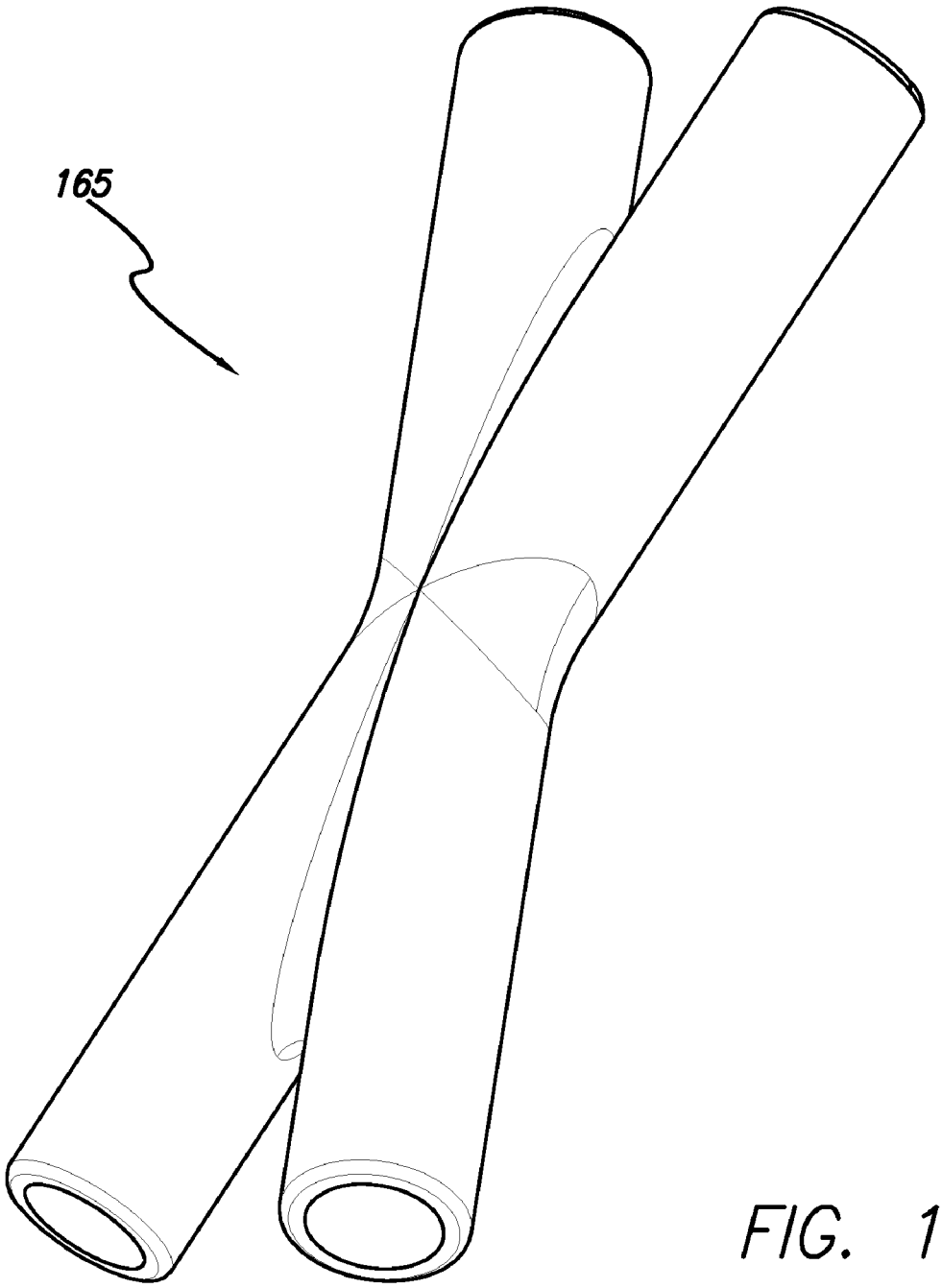
FIG. 10 is a perspective view of the x-shaped connection member.

Attached to the second end 90 of the support rod 80 is a horizontally oriented arm 110. The arm 110 has a first or connection end 115 and a second or distal end 120. In a preferred embodiment, the connection end 115 is received in a female connection piece 82. In another embodiment, the arm 110 and support rod 80 are unitary. In one embodiment, as shown in FIG. 9 there is an elastic connection rope or cord 122, which runs through the arm 110 and connects to the female connection piece 82 or second end 90 of the support rod 80. During disassembly, this elastic rope or cord 122 helps keep the components together and organized (similar to tent poles). In another embodiment, the elastic cord 122 can be omitted. In another embodiment, the arm 110 can be made of more than one piece and include a cord 122 therein that connects the separate pieces.

As shown in the figures, attached to the arm 110 with a loop or connection 140 is a target 130. The connection 140 is preferably hollow, thereby allowing the target 130 to move horizontally. The target 130 is reasonably shaped like the strike zone for baseball, but the target 130 can be shaped for different sports such as softball, cricket, football or other sports.

Figure 8:
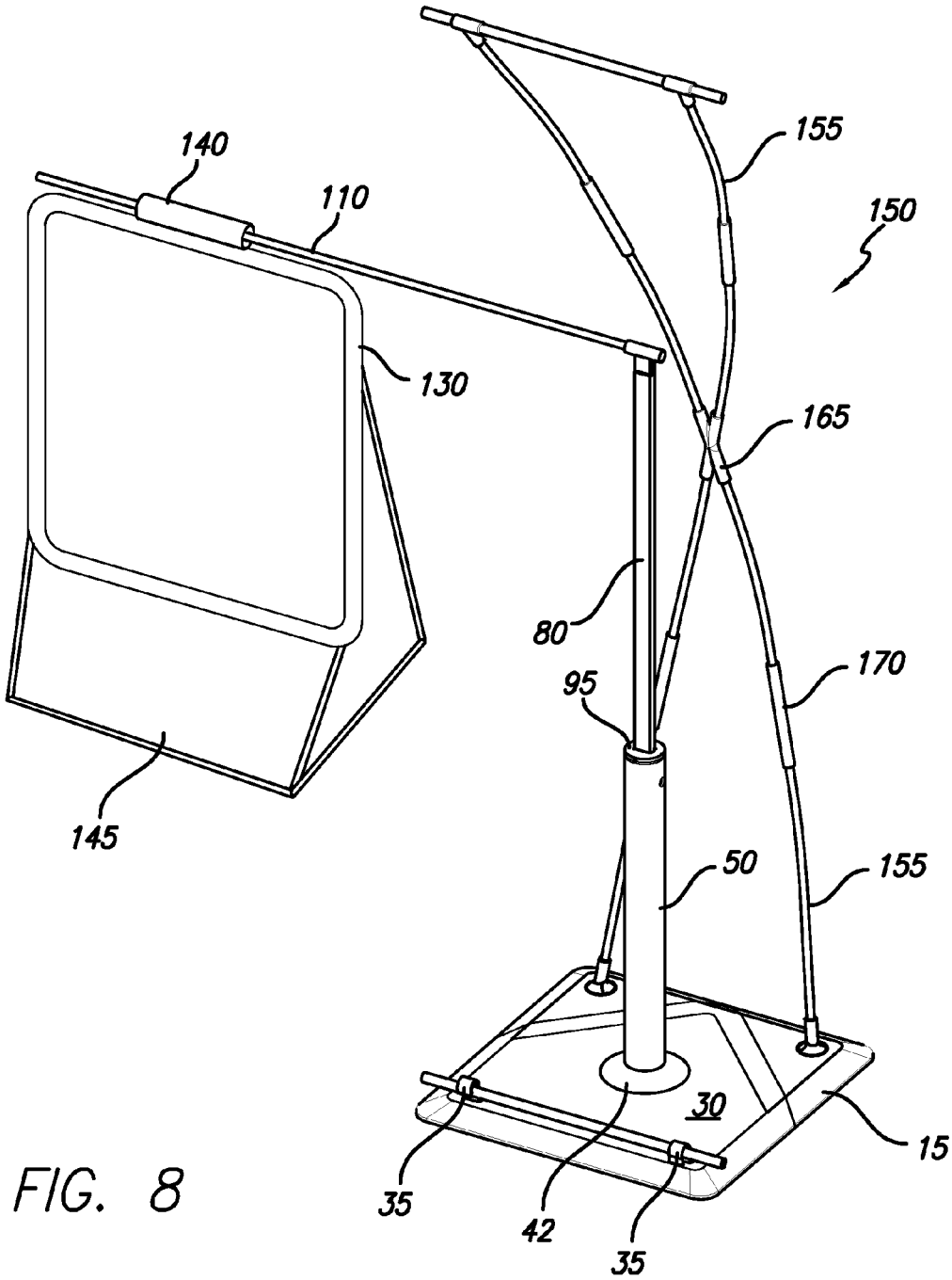
FIG. 8 is a perspective view of the apparatus of FIG. 1 with the screen removed and a collection bag or return on the target.

The target 130 frames an opening 135 through which a user can throw a ball. In other embodiments, the user could put additional aiming targets to "paint the corners". Other embodiments may include blocking patches to help the user avoid throwing a ball right down the middle of the plate. As shown in FIG. 8, in another embodiment can include a catching bag or net 145 connected to the arm 110 or the target 130.

It will be appreciated by those skilled in the art that with the height adjustment of the supporting rod 80 (along the y-axis or vertical axis), the user can raise or lower the "target zone". Also, the user can move the target right or left or along the x-axis (horizontal axis) by adjusting the position of the target 130 along the arm 110.

In a preferred embodiment, the target 130 can be changed to be oriented on either side of the panel/screen 180 to practice throwing to both left and right handed batters. In an embodiment without an elastic cord 122 in the arm 110, the arm 110 can be disengaged from one end 82*a* of the female connection piece 82 and then inserted into the other end 82*b* of the female connection piece 82. In another embodiment, a user can remove the arm 80 (or entire engagement piece 95) from the stand 50, flip the target 130 and arm 110 to the opposite side and re-engage the support rod 80 (or entire engagement piece 95). In this embodiment, the stand 50 can have key holes 65 on opposite sides.

By allowing maximum flexibility in movement of the target strike zone along both the horizontal axis and the vertical axis, the user has the ability to learn how to placement pitch or to "paint the corners".

As shown, for example, in FIGS. 1-5, in a preferred embodiment, to keep the apparatus 10 from being knocked down from a collision with a thrown ball, the apparatus 10 includes a strut or flexible support assembly 150 to support the screen or panel 180. The support assembly 150 preferably includes at least one pole 155 and at least one pole connector 170 and at least one X connector 165.

The support assembly 150 has a first assembly end (bottom) and a second assembly end (top); the first assembly end is releasably secured to the second or rear side 25 of the base 15. The bottom poles 155 are received in the female connection parts 40. The second assembly end of the support assembly 150 is releasably secured to the second end 190 of the screen/panel 180.

In the preferred embodiment, there are a plurality of poles 155 and pole connectors 170 and 165, which are all arranged together in a three dimensional "X" or cross configuration. The poles 155 meet at an "X" connector 165, which receives four different poles 155 and is able to withstand the forces transferred after the apparatus and screen are hit by a baseball or ball.

The X-shaped connector 65 provides stability along multiple axis (front and back and side to side). In a preferred embodiment, all of the poles 155 and connectors 165 and 170 include an elastic cord 122 running therethrough, similar to the arm 110 described above. This helps keeps parts together when the support assembly 150 is broken down. In this embodiment, the X-shaped connector 165 is hollow and allows the elastic cord or rope to pass therethrough. Since the X-shaped connector is "fused" at the cross point between the two planes of poles, this particular structure provides additional structure and support to absorb a hit on the screen or apparatus.

As shown in the figures, in an exemplary embodiment the X-shaped connector 165 connects four pole segments. In this embodiment, the support assembly 150 includes eight poles 155, four connection members 170 and one X-shaped connection member 165. The poles 155 can be solid, hollow or semi-hollow to allow the elastic cord or rope to hold the pieces together as desired.

By breaking up the support member 150 into the various components, it can be easily broken down into a smaller unit and easily stowed, carried, and transported. For easy reassembly and to keep from losing or disorganizing the pieces, the elastic cord or rope 122 that connects each connection piece and pole segment provides some order to this apparatus (i.e. keeps the pieces connected together but allows freedom to connect or disconnect each piece and connector). In another embodiment, the elastic cord can be omitted and each of the pieces can be separate.

In other possible embodiments, there are various possible configurations for the support assembly 150. For example, instead of the cross-pole configuration with the X-shaped connector, it is possible to have two parallel vertical poles with at least one horizontal connection or multiple horizontal configurations between the two vertical poles. In another embodiment, the support assembly can include two vertical poles at the front of the base with two diagonally extending poles that extend from the front vertical poles to the rear of the base.

Other possible configurations allow use of one support piece to connect the second end of the screen and the second end of the base. Other possible embodiments allow use of a first and a second pole, which are interconnected by a pole connection to form an X-shape; other possible embodiments allow the first and second poles to intersect and overlap, but not actually connect in the same plane, but are still interconnected by a connection device.

The screen or panel 180 has a first end (bottom) 185 and a second end (top) 190. As shown in FIG. 1, the panel 180 has a rod or stick 180*a* that can be easily attached to the attachment devices 35 on the base 15.

In a preferred embodiment, the screen 180 is two sided and either one or both sides can be a printable side 195, which can show an image 200 of a batter or another player. This feature of placing an image of a batter or of another player, which can be placed in the batters box, provides the critical visual cues and training, which allows a young pitcher to get used to throwing to a person.

In a preferred embodiment, the screen or panel 180 is made of a material that is resistant to rough play and outdoor use (sunlight, UV, wind and rain) and being hit by a baseball or other type of ball. Generally, the material should be resilient enough to withstand the wind or being hit. In addition, the screen can be made of mesh or can also have wind perforations or uniformly spaced openings to allow the wind to more readily pass through the screen and panel. The screen's image can also include a team logo or advertising.

An example of how to assemble and use the invention will now be described:

1. Place the base 15 on a flat or relatively level surface. The apparatus 10 can be used in the backyard, playing field or indoor gym. For the playing field, place the apparatus 10 in the batter's box with the screen 180 placed where a batter would stand and with the target 130 above home plate.

2. Attach the stand 50 to the base 15. As discussed above, in one preferred embodiment, there is a male connection member 42 in the relatively center portion of the base 15. The male connection member 42 can allow the stand 50 to be threaded on or include a friction type connection or other connection.

3. Attach the target arm 110 to the female connection piece 82 of the support rod 80.

4. With the target arm 110 attached, insert the first end of the support rod 80 into the first end of the stand 50; note that the engagement piece 95 (which receives the support rod 80) fits securely within the opening of the second end of the stand 50. The release button 100 will engage the key hole 65 defined in the side wall of the stand 50. This helps keep the support rod securely in place.

5. With the support rod 80 securely attached to the stand 50, the target 130 is slipped onto or hanged on the target arm 110. Note that the target 130 can be moved horizontally or left to right along the target arm 110 as desired.

6. Assemble or connect the various pieces of the support assembly 150 by attaching each pole 155 into the adjacent connection piece 170 or 165. In the preferred embodiment, the pole portion 155 and connection pieces 165 or 170 are all interconnected by an internal elastic cord or rope; this elastic cord connection helps keep multiple parts from being lost.

7. Once the proper "X" shape is formed, attach the first end of the support assembly 150 to the second side of the base 15.

8. Attach the first end of the screen 180 to the first end of the base 15, raise up the screen and attach the second end of the support assembly 150 to the second end of the screen/panel 180. Note that one may need to slightly bend the support apparatus 150 to connect to the screen/panel 180.

9. The apparatus is now ready for pitching. Note that a user can throw to the target alone with or without a receiving net or bounce back device in the catcher's position. Or, a pitcher can throw to a live catcher to simulate live game conditions.

10. The user can also attach other accessories, such as special targets or a catching bag 145.

11. Note that the user can also change the position of the target 130 to the opposite side, as described above.

12. After pitching practice, the user can disassemble the apparatus by following the previous steps in backwards fashion.

13. To convert the apparatus 10 to a batting tee, all of the components are removed from the base except the stand 50 and then the tee ball insert 70 is inserted therein.

This invention presents an effective practice and teaching tool for athletes in baseball and other throwing ball sports. This invention can be provided or sold in a kit format, which can include, without limitation: carrying case, base, stand, screen/panel or multiple screens/panels; suspension assembly; support rod; target arm; target; and "tee ball" insert. In addition, there can also be instructional written materials and a video or DVD or CD-ROM audio visual materials to show proper pitching or batting mechanics. Other accessories could include a net or catch bag for the target or the target arm. The user could also use a net or a backstop to prevent thrown balls from leaving a defined space (i.e. a user's backyard). But, note that this invention can be easily used on any practice or playing field.

Although not required or needed for this invention to work effectively, the base could also have at least one or multiple openings to allow spikes or restraining stakes to be secured to the base and to the playing surface. In addition, weights, including but not limited to sand or water filled weights, can be placed around the base to provide further stability to the apparatus.

In other embodiments, other components can be added to the apparatus. For example, the apparatus can include a light that goes on when a strike is thrown or a radar gun for providing pitch speed. In another embodiment, the device can be adapted for teaching football or soccer. In another embodiment, the entire device can be made for wiffleball (e.g., for kids ages 4-8). In this embodiment, the entire device can be made of lightweight plastics and can be easier to construct. Because of the weight of a wiffleball, the support structure can be simpler and may not be in an X configuration, but could instead be two parallel poles that extend upwardly from the front of the base and have a screen thereon.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically. Any element in a claim that does not explicitly state "means for" performing a specific function, or "step for" performing a specific function, is not be interpreted as a "means" or "step" clause as specified in 35 USC 112, P6. In particular, the use of "step of" in the claims herein is not intended to invoke the provisions of 35 USC 112, P6.

The foregoing embodiments are merely examples of the present invention. Those skilled in the art may make numerous uses of, and departures from, such embodiments without departing from the spirit and the scope of the present invention. Accordingly, the scope of the present invention is not to be limited to or defined by such embodiments in any way, but rather, is defined solely by the following claims.

What is claimed is:

1. A sport training device, comprising:

a base having a front, a rear and lateral sides extending therebetween;

a stand mounted to and extending vertically from the base, the stand having a batting configuration and a pitching configuration;

a tee ball insert for supporting a ball for a batter, the tee ball insert being removably installed in the stand when the device is configured in the batting configuration;

a support element removably installed in the stand when the device is configured in the pitching configuration, and the support element has a vertical axis and a component with a horizontal axis extendable to one or the other of the lateral side of the base;

a pitching target coupled to and horizontally movable along the horizontal axis relative to the component, the pitching target is vertically adjustable along the vertical axis of the support element, and the pitching target defines a strike zone for a pitcher.

2. A device according to claim 1, wherein the pitching target is suspended from the component beneath the horizontal axis.

3. A device according to claim 1, wherein the pitching target is extendable on either lateral side of the base such that the pitching target is located outside of a vertical perimeter of the base.

4. A device according to claim 1, wherein, in the pitching configuration, the device has a left-handed batter orientation and a right-handed batter orientation such that the pitching target is relocatable on opposite sides of the base in the pitching configuration.

5. A device according to claim 1, wherein the device has only one stand extending from the base for supporting the tee ball insert and the pitching target.

6. A device according to claim 1, further comprising a screen mounted to the device only in the pitching configuration but not in the batting configuration.

7. A device according to claim 6, wherein the screen is mounted directly to the base.

8. A device according to claim 6, wherein the screen is reversible and has a first image of a batter batting left-handed, and a second image opposite the first image of a batter batting right-handed.

9. A pitching trainer, comprising:

a plate having a front, a rear and lateral sides extending therebetween;

a stand mounted to and extending in a vertical direction from the plate;

a support element removably installed in the stand and extending in the vertical direction;

a tee ball insert for supporting a ball for a batter, the tee ball insert being removably installed in the stand when the device is configured in a batting configuration;

a target arm removably mounted to the support element and extending in a horizontal direction beyond one or the other lateral sides of the plate;

a pitching target mounted to the target arm and defining a strike zone for a pitcher, the pitching target being substantially vertical and the pitching target being located completely on one of the lateral sides of the plate;

the pitching trainer has a left-handed batter orientation and a right-handed batter orientation located on opposite sides of the plate; and a screen mounted to the plate.

10. A pitching trainer according to claim 9, wherein pitching target is repositionable on a horizontal axis of the target arm, and vertically repositionable via the support element, and the pitching target is suspended from the target arm beneath the horizontal axis.

11. A pitching trainer according to claim 9, wherein the screen is reversible and has a first image of a batter batting left-handed, a second image opposite the first image of a batter batting right-handed, and the screen has two opposite lateral side edges.

12. A pitching trainer according to claim 11 wherein the pitching target is locatable on either of the opposite lateral side edges of the screen.

13. A pitching trainer according to claim 9, wherein the support element has a vertical axis for adjusting the pitching target vertically along the vertical axis.

14. A pitching trainer according to claim 9, wherein the device has only one stand extending from the plate for supporting either the tee ball insert or the pitching target.

* * * * *